US011391248B2

(12) United States Patent
Osburg et al.

(10) Patent No.: US 11,391,248 B2
(45) Date of Patent: Jul. 19, 2022

(54) FUEL SUPPLY DEVICE

(71) Applicant: Andreas Stihl AG & Co. KG, Waiblingen (DE)

(72) Inventors: Gerhard Osburg, Kernen (DE); Dimitrios Galagas, Backnang (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 47 days.

(21) Appl. No.: 17/032,297

(22) Filed: Sep. 25, 2020

(65) Prior Publication Data

US 2021/0095619 A1 Apr. 1, 2021

(30) Foreign Application Priority Data

Sep. 30, 2019 (EP) ..... 19200476

(51) Int. Cl.

| | |
|---|---|
| ***F02M 17/04*** | (2006.01) |
| ***F02M 7/08*** | (2006.01) |
| ***F02M 19/03*** | (2006.01) |
| ***F02M 59/46*** | (2006.01) |

(52) U.S. Cl.

CPC ..... *F02M 17/04* (2013.01); *F02M 7/08* (2013.01); *F02M 19/03* (2013.01); *F02M 59/464* (2013.01); *F02M 2200/28* (2013.01)

(58) Field of Classification Search

CPC ..... F02M 17/04; F02M 7/08; F02M 19/03; F02M 59/464; F02M 2200/28

USPC ..... 261/24

See application file for complete search history.

(56) References Cited

U.S. PATENT DOCUMENTS

| | | | | |
|---|---|---|---|---|
| 5,891,369 | A * | 4/1999 | Tuggle | F02M 1/02 261/35 |
| 5,937,909 | A | 8/1999 | Clauss et al. | |
| 6,000,369 | A * | 12/1999 | Koizumi | F02M 17/04 123/179.16 |
| 6,065,739 | A * | 5/2000 | Schlossarczyk | B27B 17/00 261/35 |
| 6,149,139 | A | 11/2000 | Holderle | |
| 6,446,939 | B1 | 9/2002 | Hoppe et al. | |
| 2008/0061454 | A1 | 3/2008 | Braun | |
| 2014/0306358 | A1 | 10/2014 | Learman et al. | |

(Continued)

FOREIGN PATENT DOCUMENTS

| | | |
|---|---|---|
| CN | 201141329 | 10/2008 |
| CN | 202690251 | 1/2013 |

(Continued)

*Primary Examiner* — Mahmoud Gimie

(74) *Attorney, Agent, or Firm* — Gudrun E. Huckett

(57) ABSTRACT

A fuel supply device has a housing and an intake channel section formed in the housing. At least one fuel port opens into the intake channel section. At least one fuel channel is provided and a valve with valve plate is arranged in the fuel channel. The valve has a closed position and an open position. The valve plate contacts a valve seat in the closed position. The valve plate carries out a valve stroke between open position and closed position. At least one annular gap is formed in the fuel channel. A gap width of the at least one annular gap is matched to a length of the valve stroke of the valve plate such that the gap width is not larger than twice a length of the valve stroke. A flow cross section of the annular gap is larger than a flow cross section of the valve.

15 Claims, 3 Drawing Sheets

(56) References Cited

U.S. PATENT DOCUMENTS

| | | | | |
|---|---|---|---|---|
| 2015/0176531 | A1* | 6/2015 | Shebuski | F02M 17/04<br>261/34.1 |
| 2015/0337765 | A1* | 11/2015 | Yamazaki | F02B 63/02<br>123/73 A |
| 2020/0386192 | A1* | 12/2020 | Servatius | F02M 7/12 |

FOREIGN PATENT DOCUMENTS

| | | |
|---|---|---|
| DE | 10 2017 129 949 | 7/2018 |
| JP | S57198357 | 4/1982 |
| WO | 2006/049598 | 5/2006 |

* cited by examiner

FUEL SUPPLY DEVICE

BACKGROUND OF THE INVENTION

The invention relates to a fuel supply device, in particular a carburetor, with a housing in which an intake channel section is formed, wherein at least one fuel supply port opens into the intake channel section, wherein the fuel supply device comprises at least one fuel channel in which a valve is arranged, wherein the valve comprises a valve plate. The valve comprises an open position and comprises a closed position, wherein the valve plate contacts a valve seat in the closed position. The valve plate carries out a valve stroke between the open position and the closed position.

U.S. Pat. No. 6,149,138 discloses a membrane carburetor comprising a main nozzle with a check valve. At idle, the check valve closes off the main nozzle path so that pressure pulsations in the intake channel cannot act through the main nozzle path on the control chamber.

CN 202690251 U discloses a carburetor which comprises a screen in the idle fuel path; in this way, impurities are to be filtered out of the fuel and deposits of impurities at the idle port are to be avoided in this way.

It has been found that functional impairments, for example, unsatisfactory starting behavior or rough running of an internal combustion engine in operation, may be encountered in internal combustion engines whose fuel supply device comprises at least one valve.

The invention has the object to provide a fuel supply device with which functional impairments of an internal combustion engine are prevented.

SUMMARY OF THE INVENTION

In accordance with the invention, this is achieved by a fuel supply device that is characterized in that at least one annular gap is formed in the fuel channel, wherein the gap width of the annular gap is matched to the valve stroke of the valve plate of the valve such that the gap width is not larger than twice a length of the valve stroke, wherein the flow cross section of the annular gap is larger than the flow cross section of the valve.

It is provided that in the fuel channel, in which the valve is arranged, an annular gap is formed wherein the gap width of the annular gap is matched to the valve stroke of the valve plate of the valve such that the gap width is not larger than twice the length of the valve stroke. The flow cross section of the annular gap is larger than the flow cross section of the valve. The flow cross sections are advantageously cross-sectional areas in this context.

The annular gap is advantageously not delimited by the valve plate of the valve. The annular gap is in particular embodied separate from the valve plate of the valve. The annular gap is advantageously embodied to be spaced apart from the valve plate.

It has been found that rough running of an internal combustion engine may be the result of an unsuitable fuel supply action. This unsuitable fuel supply action may result when dirt such as cuttings or chips, which may result from the production of the fuel supply device, is positioned between the valve plate and a stop for the valve plate. These dirt particles prevent that the valve plate reaches the closed position. The function of the fuel supply device is impaired by this. Also, an unsatisfactory starting behavior may be caused by dirt particles at a valve, namely a valve of a fuel pump, in particular of a purge pump.

By matching the gap width of the annular gap to the length of the valve stroke of the valve plate, the annular gap retains dirt particles such as cuttings or chips or the like and ensures in this way that the valve plate can reach the closed position. It has been found that already with a gap width that is not larger than twice the length of the valve stroke of the valve plate blocking or prevention of movement of the valve plate can be prevented to the greatest possible extent. The flow cross section of the annular gap is in this context larger than the flow cross section of the valve. The annular gap is thus not a significantly limiting factor for the flow volume through the fuel channel.

The gap width of the annular gap is advantageously fixedly set by construction. The gap width of the annular gap is preferably not changeable or not adjustable.

Preferably, the gap width is not larger than the length of the valve stroke (amounts to at most 100% of the length of the valve stroke). Only dirt particles that are not larger than the length of the valve stroke of the valve plate can pass through the annular gap. These dirt particles are however not retained at the valve plate due to the sufficiently large valve stroke of the valve plate and can pass the valve plate in operation. In this way, blockage or preventing of movement of the valve plate by dirt particles is prevented.

The valve can be, for example, the valve of a fuel nozzle or a valve in a pump of the fuel supply device. It can be provided that the valve is a check valve or a solenoid valve with a valve plate. In case of a check valve, the movement of the valve plate between the open position and the closed position is realized due to the pressure conditions at the valve plate. In case of a solenoid valve, the valve plate is moved as a function of the current flow through a solenoid.

Preferably, the gap width of the annular gap is smaller than the length of the valve stroke of the valve plate. Particularly preferred, the gap width amounts to at most 80% of the length of the valve stroke. In this way, it can be reliably prevented that dirt particles can pass through the annular gap to the valve, get lodged between valve plate and stop, and thus prevent closing of the valve. Dirt particles that are smaller than the length of the valve stroke can pass between valve plate and stop and are then flushed away by the fuel so that these dirt particles do not cause any functional impairment.

The open position of the valve is in particular a position in which the valve plate contacts a stop. The stop and the valve seat define thereby mechanically the two end positions of the valve plate.

Advantageously, at least one annular gap is arranged upstream of the valve. The term "upstream" refers in this context to a flow direction from a fuel tank to an internal combustion engine, i.e., the usual flow direction in operation of the fuel supply device. However, it can also be provided that, in addition or as an alternative, at least one annular gap is arranged downstream of the valve. An annular gap which is arranged downstream of the valve prevents in case of back pulsations in the fuel system that dirt particles reach the valve. This can be the case, for example, when the internal combustion engine of a hand-guided work apparatus is pivoted in operation or when the internal combustion engine is turned off and fuel returns to the fuel tank.

Advantageously, the annular gap is delimited by an inner wall and an outer wall. A simple configuration of the fuel supply device results when the valve seat and the inner wall of the annular gap are embodied at the same component. Accordingly, no additional components are required for the configuration of the annular gap.

Advantageously, a main fuel nozzle opens into the intake channel section and comprises a valve. The main fuel nozzle is in this context the nozzle through which the main portion of the fuel is supplied at full load of an internal combustion engine. The main fuel nozzle is advantageously arranged in a bore of the fuel supply device. The main fuel nozzle is advantageously press-fit into a bore of the fuel supply device. In an alternative configuration, it can also be provided that the main fuel nozzle is screwed into the bore or is held in the bore by means of an elastic element, for example, by means of an O-ring. A simple configuration results when the annular gap is formed between the wall of the bore and the outer circumference of the main fuel nozzle. In this way, no additional components are required for embodying the annular gap. It is only necessary to match the dimensions of bore and outer circumference of the main fuel nozzle to each other. Particularly preferred, the annular gap extends between a first annular channel and a second annular channel. The fuel supply and the fuel discharge can be realized by the two annular channels. Advantageously, the first annular channel, the annular gap, and the second annular channel are delimited by the wall of the bore and by the outer circumference of the main fuel nozzle.

Advantageously, upstream of the annular gap at least one throttle is arranged. The throttle can be a fixed throttle in this context. The throttle is in particular a partial load fixed nozzle. It can also be provided that the at least one throttle is adjustable. An adjustable throttle can be in particular a full load adjusting screw when the valve is provided at a main fuel nozzle. Advantageously, the flow cross section of the annular gap is larger than the flow cross section of the throttle. In this way, the annular gap does not limit the flow. In an advantageous configuration, at least an adjustable throttle and at least one fixed throttle are provided.

Advantageously, the fuel supply device comprises a purge pump as a manually actuated fuel pump. The purge pump comprises a pump chamber. Advantageously, a first valve is arranged upstream of the pump chamber and a second valve is arranged downstream of the pump chamber. For valves at a purge pump, an annular gap is also advantageous in order to ensure that the valve plate opens reliably and closes reliably and is not impaired in its movement by dirt particles. In this way, the permanent function of the purge pump can be ensured. Upon actuation of the purge pump, the fuel system is reliably purged so that a good starting behavior of an internal combustion engine operated with the fuel supply device is provided.

BRIEF DESCRIPTION OF THE DRAWING

Embodiments of the invention will be explained in the following with the aid of the drawings.

DESCRIPTION OF THE PREFERRED EMBODIMENTS

Figure 1:
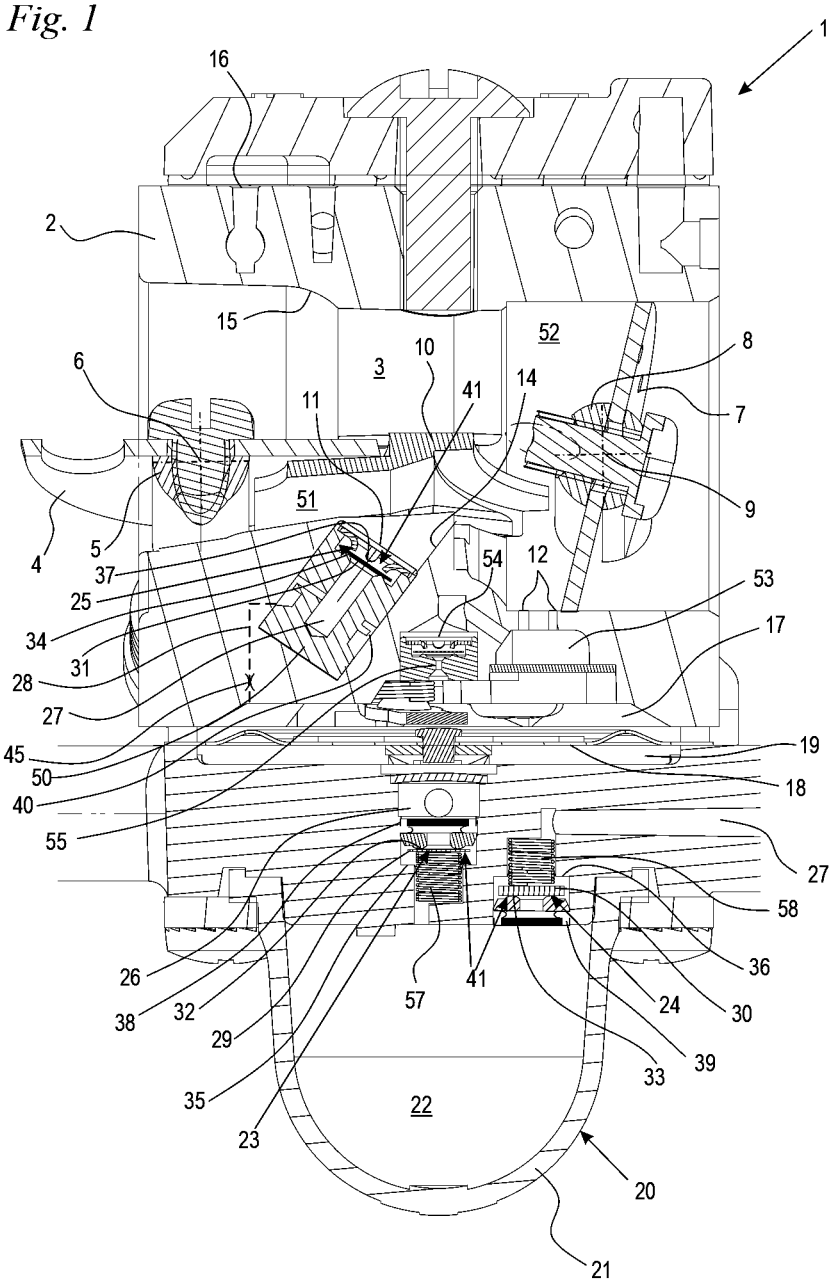
FIG. 1 is a schematic section illustration of a fuel supply device.

FIG. 1 shows schematically a fuel supply device 1 in section illustration. In the embodiment, the fuel supply device 1 in FIG. 1 is a carburetor, i.e., a fuel supply device in which the fuel is sucked in by vacuum. A different kind of fuel supply device, for example, a fuel supply device with a fuel valve that conveys the fuel under pressure and injects the fuel into the intake channel in this way, can also be provided. The fuel supply device 1 comprises a housing 2 in which an intake channel section 3 is formed. The intake channel section 3 is advantageously connected to a mixture inlet of an internal combustion engine, not illustrated. Combustion air is usually sucked in through an air filter into the intake channel section 3. In the intake channel section 3, a throttle element 7, in the embodiment a throttle flap, is supported by means of a throttle shaft 8 so as to be pivotable about an axis of rotation 9. Upstream of the throttle element 7, a choke element 4 is arranged in the intake channel section 3. It can also be provided that the fuel supply device 1 does not comprise a choke element 4. The choke element 4 in the embodiment is a choke flap which is supported by means of a choke shaft 5 so as to be pivotable about an axis of rotation 6. The throttle element 7 and the choke element 4 serve to control the open flow cross section of the intake channel section 3.

In the embodiment, the fuel supply device 1 is provided to supply a fuel/air mixture into a mixture channel as well as air into an air channel. For this purpose, the intake channel section 3 is divided by a partition wall section 10 into a mixture channel section 51 and an air channel section 52. When the choke element 4 and the throttle element 7 are completely open, they are positioned in a common plane with the partition wall section 10. In this way, a separation as complete as possible of mixture channel section 51 and air channel section 52 is achieved.

A plurality of auxiliary fuel ports 12 as well as a main fuel port 11 open into the intake channel section 3, namely into the mixture channel section 51 of the intake channel section 3. The auxiliary fuel ports 12 are arranged in the region of the throttle element 7. In the embodiment, the main fuel port 11 is arranged in the region of the partition wall section 10 and upstream of the throttle element 7.

In the embodiment, the fuel supply device 1 is embodied as a membrane carburetor to which fuel is supplied by means of the fuel pump 16. The fuel pump 16 is preferably driven by the fluctuating pressure in a crankcase of an internal combustion engine. The fuel pump 16 conveys the fuel by means of a fuel valve, not illustrated, into a control chamber 17 of the fuel supply device 1. The control chamber 17 is separated by a control membrane 18 from a compensation chamber 19. As a function of the position of the control membrane 18, i.e., as a function of the pressure conditions in the control chamber 17 and in the compensation chamber 19, an inlet valve in the control chamber 17 is opened or closed, as is well known, so that the fuel can flow in a controlled fashion into the control chamber 17.

The auxiliary fuel ports 12 are supplied from an idle chamber 53 which is connected by means of an idle check valve 54 and an idle throttle 55 to the control chamber 17.

The main fuel port 11 is formed at a main fuel nozzle 13 that is connected by means of a fuel channel 28, shown schematically in dashed line, to the control chamber 17. A throttle 45 is arranged in the fuel channel 28. The throttle 45 can be a fixed throttle, for example, a partial load fixed nozzle. However, the throttle 45 can be adjustable also. The throttle 45 can be in particular an adjusting screw. In an advantageous alternative configuration, a fixed throttle and an adjustable throttle can be provided in place of the throttle 45.

The main fuel nozzle 13 is arranged in a bore 14 of the housing 2. In the embodiment, the fuel channel 28 opens at the circumference of the bore 14. The main fuel port 11 opens in the region of a venturi section 15 into the intake channel section 3. The main fuel nozzle 13 comprises a valve 25 that is configured as a check valve. The valve 25 comprises a valve plate 31. In the closed position 41 illustrated in FIG. 1, the valve plate 31 contacts a valve seat 34. In the embodiment, the valve plate 31 contacts a stop 37 in the open position.

The fuel supply device 1 comprises a purge pump 20. The purge pump 20 is a manually actuated fuel pump that conveys fuel from the control chamber 17 into a fuel tank. The vacuum which is produced in this way in the fuel system has the effect that fuel is sucked from the fuel tank into the fuel system and the fuel system is purged thereby. In doing so, air contained in the fuel system is returned to the fuel tank. The purge pump 20 comprises a purge pump bulb 21 which is to be compressed by the operator for conveying fuel. A pump chamber 22 is provided in the purge pump bulb 21. A fuel channel 26 opens into the pump chamber 22 through a valve 23. The fuel channel 26 connects the pump chamber 22 to the control chamber 17. A valve 24 leads out of the pump chamber 22 and is connectable by means of a fuel channel 27 to the fuel tank. The valves 23 and 24 are embodied as check valves in the embodiment.

The valve 23 comprises a valve plate 29. The valve plate 29 is movable between a closed position 41, illustrated in FIG. 1, and an open position. In the closed position 41, the valve plate 29 contacts a valve seat 32 and separates in this way the fuel channel 26 from the pump chamber 22. The valve plate 29 is pretensioned by a spring 57, embodied in the embodiment as a pressure spring, in the direction toward the valve seat 32, i.e., in the direction toward the closed position 41. When a vacuum is produced in the pump chamber 22, the valve plate 29 is thus lifted off the valve seat 32 when the force applied by the spring 57 is surpassed. A stop 35 for the valve plate 29 is formed in the housing 2 and defines the open position of the valve 23 and delimits the valve stroke of the valve plate 32. Alternatively, the block length of the spring 57 can also form a stop for the valve plate 29. Also, the forces which are acting in operation at the valve plate 29 can define the open position of the valve 23.

The valve 24 which leads away from the pump chamber 22 into the fuel channel 27 comprises a valve plate 30 which in the closed position 41, illustrated in FIG. 1, contacts a valve seat 33. The valve plate 30 is pretensioned by a spring 58, in the embodiment a pressure spring, in the direction toward the closed position 41. In the housing 2, a stop 36 is formed that delimits the maximum valve stroke of the valve plate 30. Alternatively, the block length of the spring 58 can delimit the valve stroke of the valve plate 30.

When manufacturing the housing 2 of the fuel supply device 1, cuttings or chips are produced by machining the metallic housing 2. Impurities can be contained also in the fuel. Such impurities, in particular cuttings or chips, can impair the movement of the valve plates 29, 30, 31. The impurities can become lodged between valve plate 29, 30, 31 and valve seat 32, 33 and 34 or between valve plate 29, 30, 31 and stop 35, 36, 37 and thereby block or make difficult movement of the valve plate 29, 30, 31.

In order to prevent that impurities can reach the region of the valves 23, 24, 25, the arrangement of an annular gap is provided. In the flow direction from the control chamber 17 to the pump chamber 22, an annular gap 38 is arranged upstream of the valve 23. In flow direction, the annular gap 38 is positioned at a distance from the valve plate 29 of the valve 23. In flow direction from the pump chamber 22 to the fuel channel 27, an annular gap 39 is arranged upstream of the valve 24. The annular gap 39 is positioned at a distance from the valve plate 30 of the valve 24 in flow direction. In flow direction from the fuel channel 28 to the main fuel port 11, an annular gap 40 is arranged upstream of the valve 25 in the flow direction. The annular gap 40 is positioned at a distance from the valve plate 31 of the valve 25 in flow direction. The annular gaps 38, 39, and 40 are embodied to be separate from the valve plates 29, 30, 31, respectively. The annular gaps 38, 39 and 40 do not extend along the outer circumference of the valve plate 29, 30 or 31. The annular gaps 38, 39, and 40 are each arranged at a distance from the valve plates 29, 30, 31, respectively.

Figure 2:
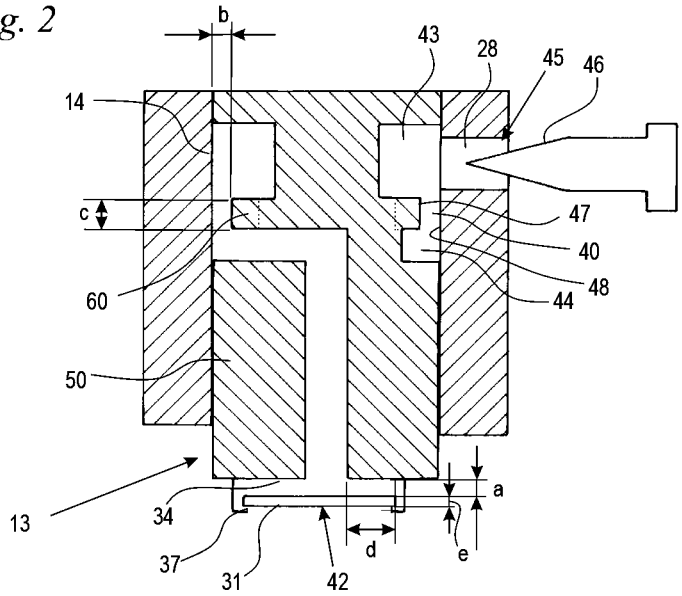
FIG. 2 is a schematic enlarged illustration of the main fuel nozzle of the carburetor of FIG. 1.

In FIG. 2, the main fuel nozzle 13 is illustrated schematically at an enlarged scale. The valve 25 is in its open position 42. In the open position 42, the valve plate 31 has carried out a valve stroke a relative to the closed position 41 illustrated in FIG. 1. The valve plate 31 contacts the stop 37. The valve plate 31 is positioned at a distance from the valve seat 34 corresponding to the length of the valve stroke a. The length of the valve stroke a can be, for example, 0.05 mm to 1 mm. The main fuel nozzle 13 comprises a base body 50 that has a substantially cylindrical shape. The base body 50 is press-fit into the bore 14 of the housing 2. In an alternative embodiment, the base body 50 can also be screwed into the bore 14 or can be held in the bore 14 by means of an elastic element such as an O-ring or the like.

In FIG. 2, the throttle 45 is schematically illustrated as an adjustable throttle with a valve needle 46. By means of the throttle 45, the fuel channel 28 opens into a first annular channel 43 which is formed between the base body 50 of the main fuel nozzle 13 and the wall of the bore 14. In the embodiment, the first annular channel 43 is formed by a circumferentially extending groove at the base body 50. A second annular channel 44 is arranged at a distance to the first annular channel 43 and is also delimited by the base body 50 and the wall of the bore 14. The second annular channel 44 is also formed by a circumferentially extending groove at the outer circumference of the base body 50. The annular gap 40 extends between the annular channels 43 and 44. The annular gap 40 is delimited by an inner wall 47 and an outer wall 48. The inner wall 47 is formed by the outer circumference of the base body 50. The outer wall 48 is the wall of the bore 14.

In an alternative embodiment, the inner wall 47 can be formed by an enlarged portion which is extruded onto the base body 50. It can also be provided that the inner wall 47 is formed by the outer circumference of a ring 60 held at the base body 50. This is indicated schematically with a dashed line in FIG. 2.

The annular gap 40 comprises a gap width b which is matched to the length of the valve stroke a of the valve 25. The gap width b corresponds to the distance between inner wall 47 and outer wall 48. The gap width b is not larger than twice the length of the valve stroke a. The gap width b is in particular not larger than the length of the valve stroke a. Advantageously, the gap width b is smaller than the length of the valve stroke a. Preferably, the gap width b amounts to at most 80% of the length of the valve stroke a. The gap width B amounts advantageously to at least 30%, in particular at least 50%, of the length of the valve stroke a. In this way, manufacture is simplified. The gap width b can be, for example, 0.04 mm to 2 mm, in particular 0.04 mm to 1.6 mm, advantageously 0.05 mm to 1.5 mm. The length of the valve stroke a can amount to, for example, 0.05 mm to 1.0 mm. The usually occurring chips or cuttings are mostly significantly larger than the gap width b so that a gap width b that is larger than the length of the valve stroke a is also able to mostly retain the occurring cuttings. The gap width b is constructively fixedly predetermined. The gap width b is not adjustable and cannot be changed by the user.

The flow cross section of the annular gap 40 is greater than the flow cross section of the valve 25. In this way, the annular gap 40 does not limit the flow rate. The flow cross section of the annular gap 40 is advantageously larger than the flow cross section of the throttle 45. When the throttle 45 is adjustable, the flow cross section of the annular gap 40 is preferably larger than the largest flow cross section that can be adjusted by the throttle 45.

The annular gap 40 comprises a gap length c. The gap length c is advantageously comparatively small. The gap length c amounts advantageously to less than half of the gap width b. The gap length c amounts advantageously to 0.02 mm to 1.5 mm, in particular 0.02 mm to 1.0 mm, preferably 0.1 mm to 0.5 mm.

In its closed position 41 (FIG. 1), the valve plate 31 contacts the valve seat 34 across a valve seat width d. The valve seat width d in case of a flat valve seat 34 (as illustrated) is the difference between the valve seat outer radius and the valve seat inner radius. The gap length c is advantageously smaller than 2 times the width d for a valve with a flat valve seat 34. In case of a valve with a round valve seat 34 (not illustrated), the gap length c is advantageously smaller than 2 times the valve plate thickness e.

The gap width of the annular gaps 38 and 39 (FIG. 1) is matched in a corresponding manner to the length of the valve stroke of the valve plates 29 and 30 of the valves 23 and 24 of the purge pump 20.

Figure 3:
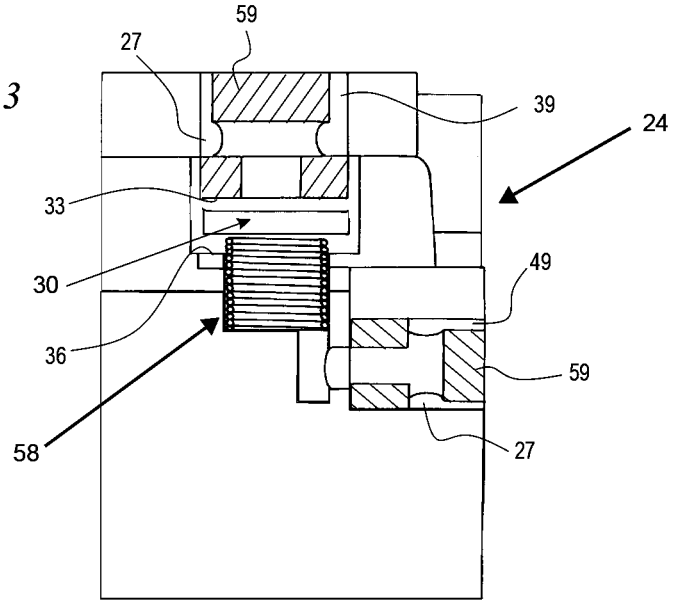
FIG. 3 is a schematic section illustration of a check valve of the purge pump of the carburetor of FIG. 1.

FIG. 3 shows an embodiment of a valve 24 of the purge pump 20 in which an annular gap 39 is arranged in flow direction upstream of the valve 24. A second annular gap 49 is arranged in flow direction downstream of the valve 24. The annular gap 49 protects the valve 24 from dirt which may reach the valve 24 in case of a flow in opposite direction. This can be the case, for example, when turning off the internal combustion engine when fuel still contained in the fuel system drains into the fuel tank. In the embodiment, the annular gaps 39 and 49 are embodied at insertion parts 59 which are inserted into the fuel channel 27 upstream and downstream of the valve 24.

Figure 4:
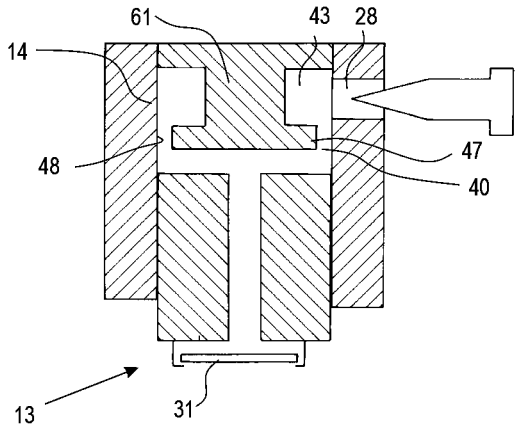
FIG. 4 is an embodiment variant of the main fuel nozzle of FIG. 2.

In the embodiment according to FIG. 4, the check valve and the annular gap 40 are embodied at separate components. The check valve is embodied at the base body 50. The annular gap 40 is delimited by a component 61. The component 61 is separate from the base body 50 and press-fit into the bore 14. The component 61 comprises the first annular channel 43 into which the fuel channel 28 opens. The inner wall 47 which delimits the annular gap 40 is moreover embodied at the component 61.

Figure 5:
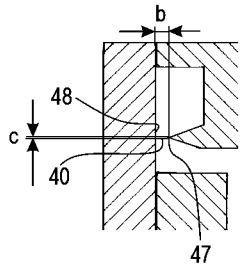
FIG. 5 is an enlarged illustration of an embodiment variant of the annular gap.
Figure 6:
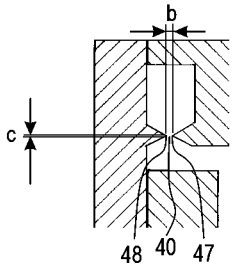
FIG. 6 is an enlarged illustration of another embodiment variant of the annular gap.
Figure 7:
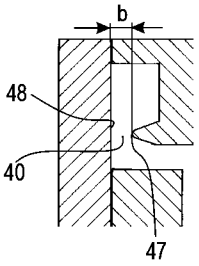
FIG. 7 is an enlarged illustration of yet another embodiment variant of the annular gap.

FIGS. 5 through 7 show different embodiment variants for the annular gap 40. The annular gaps 38, 39, and 49 can be designed in a corresponding manner.

In the embodiment according to FIG. 5, the inner wall 47 is embodied with an outwardly tapering cross section, in particular with a triangular cross section. The gap length c is thereby minimized. The outer wall 48 is cylindrically embodied.

In the embodiment according to FIG. 6, the inner wall 47 and the outer wall 48 are embodied with tapering, in particular pointedly tapering, cross section. This also results in a minimal gap length c.

In the embodiment according to FIG. 7, the inner wall 47 is embodied with tapering cross section. The inner wall 47 however does not taper to a point but is rounded. The outer wall 47 is cylindrically embodied.

Arbitrary combination of the aforementioned configurations of inner wall 47 and outer wall 48 may be advantageous also.

Advantageously, the flow cross sections are cross-sectional areas in the invention.

The specification incorporates by reference the entire disclosure of European priority document 19 200 476.0 having a filing date of Sep. 30, 2019.

While specific embodiments of the invention have been shown and described in detail to illustrate the inventive principles, it will be understood that the invention may be embodied otherwise without departing from such principles.

What is claimed is:

1. A fuel supply device comprising:

a housing;

an intake channel section formed in the housing;

at least one fuel port that opens into the intake channel section;

at least one fuel channel;

a valve arranged in the at least one fuel channel;

the valve comprising a valve plate, wherein the valve comprises a closed position and an open position, wherein the valve plate contacts a valve seat in the closed position, and wherein the valve plate carries out a valve stroke between the open position and the closed position;

at least one annular gap formed in the at least one fuel channel, wherein the at least one annular gap comprises a gap width;

at least one throttle arranged upstream of the at least one annular gap;

a flow cross section of the at least one annular gap being larger than a flow cross section of the valve;

the gap width and a length of the valve stroke between the open position and the closed position matched to each other such that the gap width is not larger than twice the length of the valve stroke.

2. The fuel supply device according to claim 1, wherein the gap width amounts to at most 100% of the length of the valve stroke.

3. The fuel supply device according to claim 2, wherein the gap width amounts to at most 80% of the length of the valve stroke.

4. The fuel supply device according to claim 1, wherein the valve plate is contacting a stop in the open position.

5. The fuel supply device according to claim 1, wherein the at least one annular gap is arranged upstream of the valve.

6. The fuel supply device according to claim 1, wherein the at least one annular gap is arranged downstream of the valve.

7. The fuel supply device according to claim 1, wherein the at least one throttle is adjustable.

8. The fuel supply device according to claim 1, wherein the flow cross section of the at least one annular gap is larger than a flow cross section of the at least one throttle.

9. The fuel supply device according to claim 1, further comprising a purge pump comprising a pump chamber, wherein the fuel supply device comprises two of said valve, wherein a first one of said two valves is arranged upstream of the pump chamber and a second one of said two valves is arranged downstream of the pump chamber.

10. The fuel supply device according to claim 1, wherein the valve is a check valve.

11. The fuel supply device according to claim 1, configured as a carburetor.

12. A fuel supply device comprising:

a housing;

an intake channel section formed in the housing;

at least one fuel port that opens into the intake channel section;

at least one fuel channel;

a valve arranged in the at least one fuel channel;

the valve comprising a valve plate, wherein the valve comprises a closed position and an open position, wherein the valve plate contacts a valve seat in the closed position, and wherein the valve plate carries out a valve stroke between the open position and the closed position;

at least one annular gap formed in the at least one fuel channel;

the at least one annular gap comprising a gap width;

the gap width matched to a length of the valve stroke of the valve plate of the valve such that the gap width is not larger than twice the length of the valve stroke;

a flow cross section of the annular gap being larger than a flow cross section of the valve;

the at least one annular gap delimited by an inner wall and by an outer wall; and the valve seat and the inner wall of the at least one annular gap formed at the same component of the fuel supply device.

13. A fuel supply device comprising:

a housing;

an intake channel section formed in the housing;

at least one fuel channel;

a main fuel nozzle comprising a valve arranged in the at least one fuel channel and comprising at least one fuel port that opens into the intake channel section;

the valve comprising a valve plate, wherein the valve comprises a closed position and an open position, wherein the valve plate contacts a valve seat in the closed position, and wherein the valve plate carries out a valve stroke between the open position and the closed position;

the main fuel nozzle arranged in a bore of the housing;

at least one annular gap formed in the at least one fuel channel;

the at least one annular gap comprising a gap width;

the gap width matched to a length of the valve stroke of the valve plate of the valve such that the gap width is not larger than twice the length of the valve stroke; a flow cross section of the annular gap being larger than a flow cross section of the valve; and the at least one annular gap formed between a wall of the bore of the housing and an outer circumference of the main fuel nozzle.

14. The fuel supply device according to claim 13, wherein the at least one annular gap extends between a first annular channel and a second annular channel.

15. The fuel supply device according to claim 14, wherein the first annular channel, the at least one annular gap, and the second annular channel are delimited by the wall of the bore and by the outer circumference of the main fuel nozzle.

* * * * *